United States Patent [19]

Schevey et al.

[11] 4,431,037

[45] Feb. 14, 1984

[54] LOW PARTICULATE LIQUID FILLING MACHINE AND METHOD

[75] Inventors: William R. Schevey, Honesdale, Pa.; Frank Calderoni, Antioch, Calif.; Raymond E. Trunk, Madison, N.J.; Harold M. Lehman, Dover, N.J.; John J. Jandura, Jr., Towaco, N.J.

[73] Assignee: Allied Corporation, Morris Township, Morris County, N.J.

[21] Appl. No.: 334,662

[22] Filed: Dec. 28, 1981

[51] Int. Cl.[3] ..... B65B 3/04

[52] U.S. Cl. ..... 141/5; 141/172; 198/345; 198/475; 198/836; 198/862; 254/340

[58] Field of Search ..... 141/1-12, 141/14, 37-67, 230, 250-310, 367-386, 129-229; 53/247, 249, 250; 198/339, 345, 862, 836, 475; 254/DIG. 2, 98, 103, 340

[56] References Cited

U.S. PATENT DOCUMENTS 2,718,377 9/1955 Ward ..... 254/340

3,103,959 9/1963 Anderson et al. ..... 141/172

*Primary Examiner*—Houston S. Bell, Jr.

*Attorney, Agent, or Firm*—Arthur J. Plantamura; Jay P. Friedenson; Richard C. Stewart

[57] ABSTRACT

An improved automatic bottle filling apparatus is provided. The apparatus includes a spring loaded back pressure plate which avoids jamming of bottles that are carried by conveyor. A bottle detection system comprising a photoelectric device or microswitch assures positioning and detection of an individual bottle. Vibration is essentially dampened by guide plates. Overheating of the drive motors to operate the vertical movement is obviated by use of a pair of continuously operated motors and running in opposite directions connected to mechanical actuators and by means of clutch brake mechanisms.

7 Claims, 6 Drawing Figures

FIG. 5
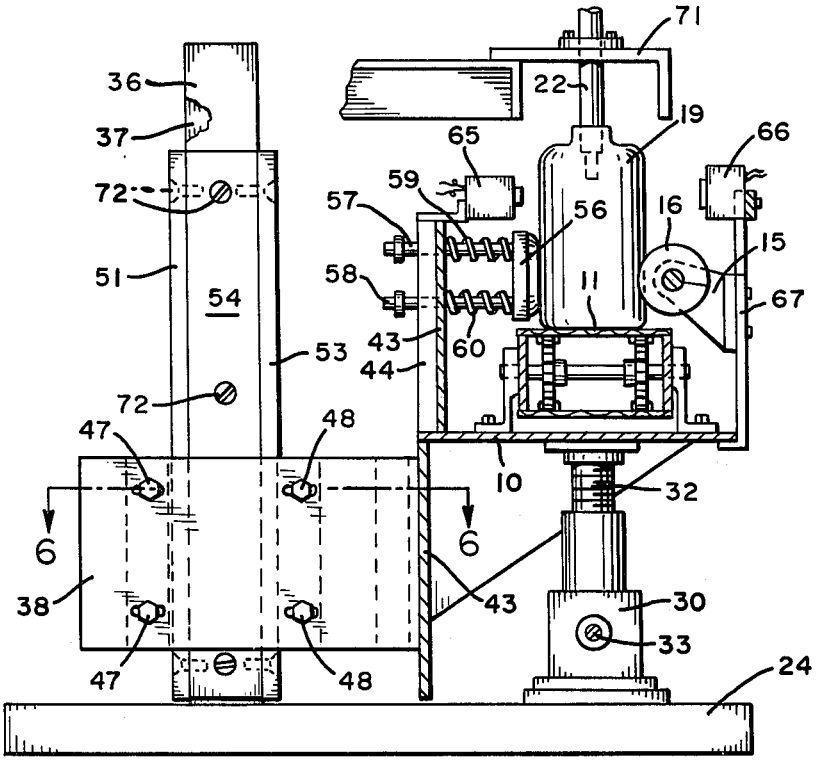
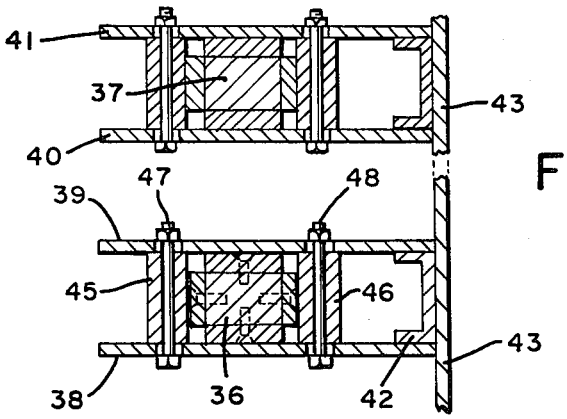
FIG. 6

LOW PARTICULATE LIQUID FILLING MACHINE AND METHOD

DESCRIPTION

This invention relates to an improved liquid filling machine and method of the type wherein a plurality of containers such as bottles are delivered and aligned simultaneously under a plurality of vertically disposed filler heads that are provided with remote controlled valve actuated liquid feed supply and inert gas supply conduits for each filler head.

More particularly the invention is concerned with arrangements of this kind having an improved delivery positioning and detecting arrangements for the bottles to be filled.

The present invention is an improvement on the apparatus and method disclosed and claimed in the U.S. Pat. No. 4,279,279 of W. R. Schevey, et al. As disclosed in that patent the inventions and apparatus and a method of filling containers with high purity liquids the purity and, therefore, the avoidance of contamination of which is often critical for some applications, such as semiconductor processing.

In U.S. Pat. No. 4,279,279 an apparatus is disclosed wherein filler head assemblies include a liquid feed channel extending vertically downward and an inert gas feed channel extending vertically downward adjacent the liquid feed channel to apertures below. A vertically moveable platform is positioned beneath the filler head assemblies. Bottle delivery means are provided for delivering and aligning a plurality of bottles onto the vertically moveable platform; the opening of each bottle being aligned beneath the apertures of filler head assembly. Lift means are provided for lifting the vertically moveable platform, when the bottles are aligned beneath the filler heads, upwardly until the lower end of the apertures is within a bottle without contact being made between the bottle and the filler head assembly. A liquid feed means delivers liquid into each bottle when the vertically moveable platform is raised. An inert gas flow at substantially constant pressure senses back pressure of said inert gas and shuts off the flow of liquid to the adjacent liquid feed channel at a location remote from said filler head assemblies when back pressure of inert gas caused by the liquid level in a bottle reaching a predetermined fill level is sensed.

The related method of U.S. Pat. No. 4,279,279 involves the automatic filling bottles with high purity liquid and comprises delivering and aligning a plurality of bottles beneath filler heads and lifting bottles until the lower end of each filler head is received within a bottle without contact being made between a filler head and a bottle, feeding liquid to and through each filler head into the corresponding bottle, sensing when a selected level of liquid is reached in each bottle and shutting off the flow of liquid to each filler head at a location remote from the filler head when the liquid level in the corresponding bottle has reached the selected level.

The prior art apparatus, while operable, suffers from occasional unreliability in detection of the presence of an individual bottle at a filling station; from heating of the vertical drive motors due to frequent reversing; from the vibration of mechanism which effects vertical movement of the conveyor; and from jamming of bottles being conveyed. Accordingly, a need exists for an improved bottle filling apparatus of this type which avoids the foregoing drawbacks.

SUMMARY OF THE INVENTION

The present invention provides an improved delivery and bottle sensing apparatus which includes at least the following features:

a photoelectric or microswitch device is employed to determine the presence of a bottle at a specific location;

a set of guides, riding on support members, is used to inhibit vibration in the vertical movement of the bottle support conveyor.

To avoid jamming of bottles entering the conveyor mechanism, a spring loaded back plate is adapted to yield sufficiently to avoid occurrence of jamming.

Motor overheating, caused by frequent reversing of the motor which raises and lowers the conveyor, is eliminated by use of two continuously operated drive motors operated in opposite directions and connected to the lift mechanism through a pair of clutch brakes.

These and additional features and advantages of the invention will become apparent from the detailed description provided with reference to the accompanying drawings.

BRIEF DESCRIPTION OF THE DRAWINGS

FIG. 5 is an end elevational view taken along line 5—5 of FIG. 4.

FIG. 6 is plan sectional view taken along line 6—6 of FIG. 5.

DETAILED DESCRIPTION OF THE INVENTION

The present invention is concerned essentially with an improved bottle delivery locator and detecting system. When the term "bottle" is used herein, it connotes not only glass bottles but also various other containers, e.g., metal, plastic or paperboard cartons.

The delivery system may be viewed as an arrangement for delivering bottles onto the platform beneath the filler heads and aligning the bottles beneath the filler heads with a precision that will enable the bottles, when lifted, to surround the lower ends of the filler heads without making contact with the filler heads.

Once the bottles are filled and the platform lowered, a conveyor is activated to move a set of filled bottles away from the filler heads and to bring a subsequent set of empty bottles under the filler heads.

In accordance with the invention an improved delivery system is provided which includes at least the following features:

A. a drive arrangement including a pair of motors continuously driven in opposite directions is used for actuating the vertically moveable platform, without requiring starting and stopping, i.e., reversing the motor;

B. Platform vibration stabilizing guide system;

C. a turning screw bottle delivery conveyor in combination with a spring pressure plate to deliver and precisely locate the bottles horizontally (side to side and front to back) more efficiently and without having the bottles bind because of close tolerance during the horizontal deliver path;

D. a detector mechanism such as photoelectric sensor is incorporated to detect the absence of an individual bottle from its location and to prevent opening of the filler valve to that specific filler head.

DESCRIPTION OF THE PREFERRED EMBODIMENT

Figure 1:
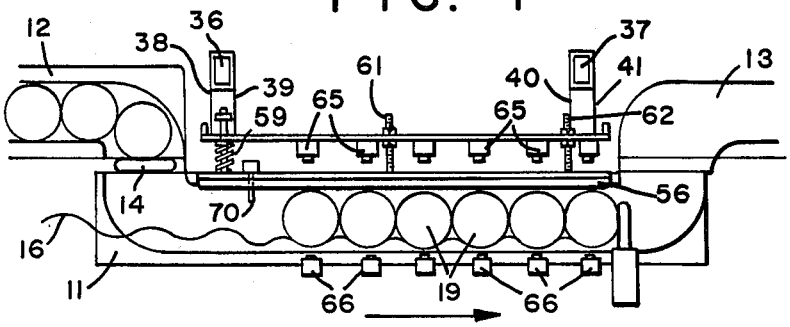
FIG. 1 is a plan view of the filler segment of the container filling machine of the invention.
Figure 2:
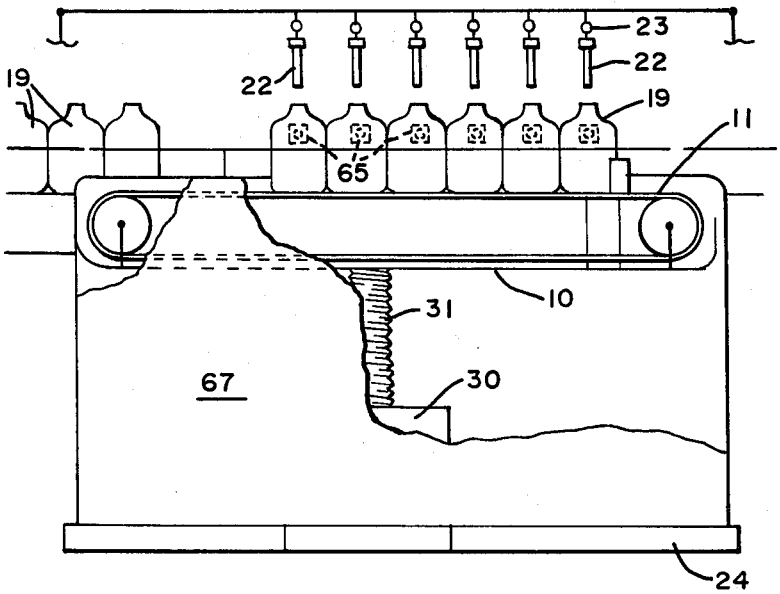
FIG. 2 is an elevational view of the segment of FIG. 1.
Figure 3:
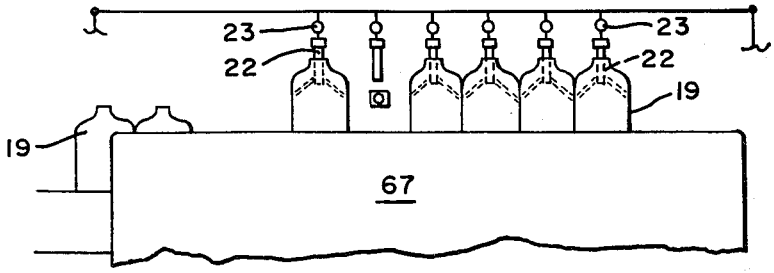
FIG. 3 is an elevational view of the segment of the machine showing a bottle missing and the bottle detector.

As seen by reference to FIGS. 1–3 of the drawing, the filling machine comprises a conveyor system including an input conveyor 12, a central conveyor portion 11 movable vertically with the platform 10 on which it is mounted and an exit conveyor segment 13 which removes the filled bottles or containers 19. An inlet gate 14 allows only a regulated number of bottles to the movable conveyor which may be arranged by means of a conventional logic control mechanism. A bottle transfer screw 16 syncronized with conveyor 11 is employed to accurately position the bottles 19. To avoid binding or jamming of the bottles being conveyed, the input section of the backplate or pressure plate 56 is spring loaded at the input end by a suitable spring 59. The pressure plate 56 is suitably secured also at one or more intermediate points such as with bolts and back up mats shown at 61 and 62. The pressure plate 56 yieldably holds the bottles securely against the screw 16 to avoid undesirable lateral movement.

To detect the absence of a bottle in a filling position and thereby avoiding the opening of a filler valve in that vacant position a suitable detector means such as a photoelectric eye 65 in combination with a detector 66 may be employed. In lieu of the photoelectric detector 65, 66 or in addition thereto a micro switch 70 may be utilized. Where for example the micro switch or photocell 70 is used alone, it may be employed in conjunction while a suitable conventional logic circuit to index the bottles with the screw.

To dampen vibration and stabilize movement, particularly lateral vibrations during vertical feed of the platform 10, conveyor 11 and screw 16, a modified support column arrangement is provided. As shown by reference to FIG. 1 and FIG. 5 and from the detail in FIG. 6 a pair of vertical supports columns 36 and 37 are employed. Rectangular columns 36 and 37 are provided on each face with a wear plate, i.e., plates 51, 52, 53 and 54, which are of suitable composition, e.g., metal such as brass, sintered composites, or plastic. A polymeric material, such as a polyolefin or fluorocarbon, e.g., a high molecular polyethylene or tetrafluoroethylene is preferably employed. The wear plates are suitably secured to the vertical supports 36 and 37 such as by recessed fasteners 72. The supports 36 and 37 are secured to skirt 43 which in turn is secured to the movable platform 10 by guide plates 38, 39, 40 and 41. A bracket 42 is used to appropriately secure the guide plates to the skirt 43. As better illustrated in FIG. 6 the guide plates 38 and 39 for one of the vertical support 36 is shown and described in greater detail. As shown, adjustable guide blocks 45 and 46 are spaced between and secured such as by bolts 47 and 48 to the guide plates 38 and 39. When secured in place the guide blocks 45 and 46 and the guide plates 38 and 39 bear against the respective forces of the wear plates 51 through 54 and inhibit vibration on the platform 10, carrying conveyor 11 and screw 16, transverses in its up and down vertical movements during the filling cycle. As shown by reference to FIG. 5 the timing screw 16 is fastened by means of bracket 15 to the front skirt 67.

A plurality of filler nozzles and solenoids 23 are held securely such as by bracket 71. The details of the filler nozzle and valve arrangements as well as the significance of maintaining a separation between the bottles and filler nozzle are described in greater detail in the aforementioned U.S. Pat. No. 4,279,279.

The time screw 16 and conveyor 11 are driven by motor 17 through a suitable clutch-gear box 18. A timing belt 21 is used to synchronize the conveyor belt 11 and timing screw 16.

Figure 4:
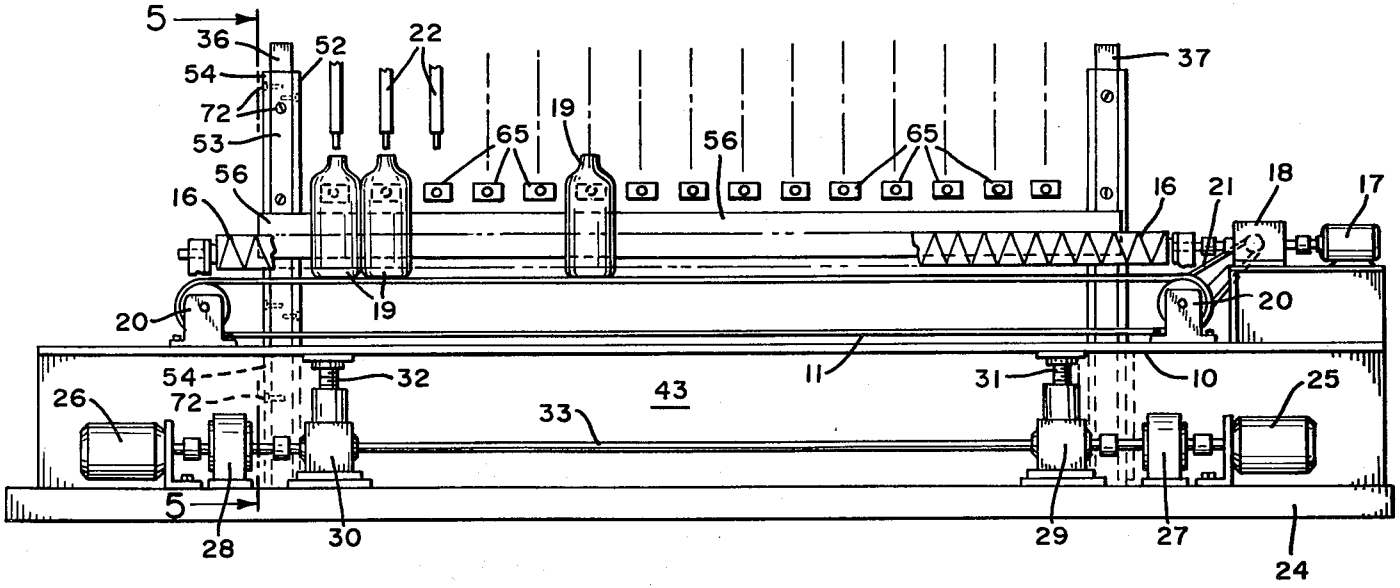
FIG. 4 is a further elevational view of the filling machine showing a more complete structure including dual motors permitting rapid cycling of vertical movement.

The details of the lift mechanism are described by reference to FIG. 4. As shown a pair of mechanical actuators 29 and 30 are connected by jack shaft 33. When the jack shaft 33 is rotated in one direction the ball nut screws 31 and 32 raise the platform 10 (conveyor 11 base). When the jack shaft 33 is rotated in the opposite direction the platform 10 is lowered. To accomplish rapid cycling and to better avoid motor burn out, two continuously running motors 25 and 26 running in opposite directions are connected to the jack shaft 33 by clutch brakes 27 and 28. The desired direction is governed by the respective clutch engaging the jack shaft 33. If no movement is desired both clutches 27 and 28 are disengaged and the brake is engaged. This system of continuously running paired opposite direction motor avoids the severe effects of starting and stopping the motor which causes overheating and burn out or complex and expensive gearing arrangements which require appreciable maintenance.

Various changes may be made in details of the improved container filling machine of the present invention without departing from the several inventive features herein disclosed and claimed.

We claim:

1. In an apparatus for automatically filling containers with high purity liquid without generating particulate contamination and without contact being made between a container and a filler head assembly which comprises a mechanism for horizontally delivering and aligning a plurality of containers to be filled beneath a plurality of filler heads, a support means and locator means for positioning said containers for filling, means for lifting the support means until the lower end of each filler head is received within a container and for lowering said container upon being filled to a selected level and means for feeding liquid to and through each filler head into the corresponding container, sensing when a selected level of liquid is reached in each container and shutting off the flow of liquid to each filler head at a location remote from the filler head when the liquid level in the corresponding container has reached the selected level, the improvement in said means for lifting the lowering said support for the containers comprising a pair of motors each of which during operation of the apparatus is driven continuously at a substantially uniform rate, one of said motors being rotated in a direction to provide exclusively the lifting motion and the other to provide exclusively the lowering motion for said platform, and means to engage the said respective motors to provide the lift movement for said platform and to engage the other motor to provide the lowering movement for said platform and a vibration damping support guide comprising wear plates on vertical supports to inhibit vibration during vertical movement of the container platform.

2. The apparatus of claim 1 wherein the mechanism for delivering and aligning the containers below the filler heads includes a pressure plate and wherein the input end of the pressure plate is spring loaded to retain said containers secure against relative movement to avoid jamming of the containers as the bottles are being delivered horizontally.

3. The apparatus of claim 2 wherein the containers are bottles and the mechanism for horizontally delivering the bottles incorporates a bottle transfer screw which engages and accurately positions the bottles horizontally as the screw rotates.

4. The apparatus of claim 1 wherein the containers have a cylindrical cross section and a mechanism for delivering and aligning the containers below the filler heads includes a rotatable timing screw and in combination therewith a spring loaded pressure plate that biases the containers within the valley of and against the two contiguous threads of the timing screw.

5. The apparatus of any of claims 1 through 4 wherein an electric sensor which is interconnected with a valve for the liquid feeding means is utilized to detect the absence of a container and to inhibit opening of the valve to a filler head in which the absence of a container in position is detected.

6. A method for automatically simultaneously filling a plurality of bottles with a high purity liquid without contact being made between a filler head and a container wherein the containers are delivered and aligned horizontally on a support beneath a plurality of filler heads and wherein the support is raised by vertical lifting and lowering so that during the filling operation the aperture of a filler head is received within a container when the containers have been elevated to a predetermined height, characterized in that drive means to exclusively raise and exclusively lower said support are continuously and simultaneously operated at a substantially uniform rate, means to engage the disengage said drive means, respectively, to raise and lower said container support and inhibiting vibration during vertical movement of the supporting by employing wear plates to the vertical supports for said container support.

7. The method of claim 6 further characterized in that side to side movement of said container is inhibited by confirming said container between a spring biased pressured plate and a horizontal screw conveyor.

* * * * *